United States Patent [19]

Berger et al.

[11] 4,407,359

[45] Oct. 4, 1983

[54] PLATE HEAT EXCHANGER

[75] Inventors: Raymond Berger, Grenoble; Maurice B. de Cachard, La Tronche; Alain Collet, Beaurepaire; Didier Costes, Meudon; André Gouzy, Saint Ismier; Guy Dupuy, Beaurepaire; Pierre Caunes, Sassenage; Claude Chevrier, Meylan, all of France

[73] Assignees: Commissariat a l'Energie Atomique; Alusuisse France S.A., both of France

[21] Appl. No.: 285,748

[22] Filed: Jul. 22, 1981

[30] Foreign Application Priority Data

Jul. 25, 1980 [FR] France ..... 80 16472
Apr. 2, 1981 [FR] France ..... 81 06641

[51] Int. Cl.[3] ..... F28F 3/08
[52] U.S. Cl. ..... 165/167
[58] Field of Search ..... 165/166, 167

[56] References Cited

U.S. PATENT DOCUMENTS 3,743,011 7/1973 Frost ..... 165/167 X
4,219,079 8/1980 Sumitomo ..... 165/167 X
4,291,754 9/1981 Morse et al. ..... 165/167 X

*Primary Examiner*—Sheldon J. Richter

[57] ABSTRACT

The invention relates to a rigid structure plate heat exchanger.

The plates of this exchanger comprise a central exchange area and two parallel borders which, when stacked, form two distributor blocks. For one of each pair of spaces distribution takes place in a particular block by issuing directly on to the face of the stack, while for the other space in the pair it takes place by issuing on to a line of passages obtained by facing perforations throughout the stack. The perforations are elongated in the flow direction of the fluids from one distributor block to the other. The borders of the plates are staggered on either side of the plane of the central area. One of the borders is in planar contact with the border of the upper plate. The other border is in contact with the border of the lower plate leading to a so-called concertina structure closing alternate spaces in each distributor block.

14 Claims, 13 Drawing Figures

PLATE HEAT EXCHANGER

Figure 1:
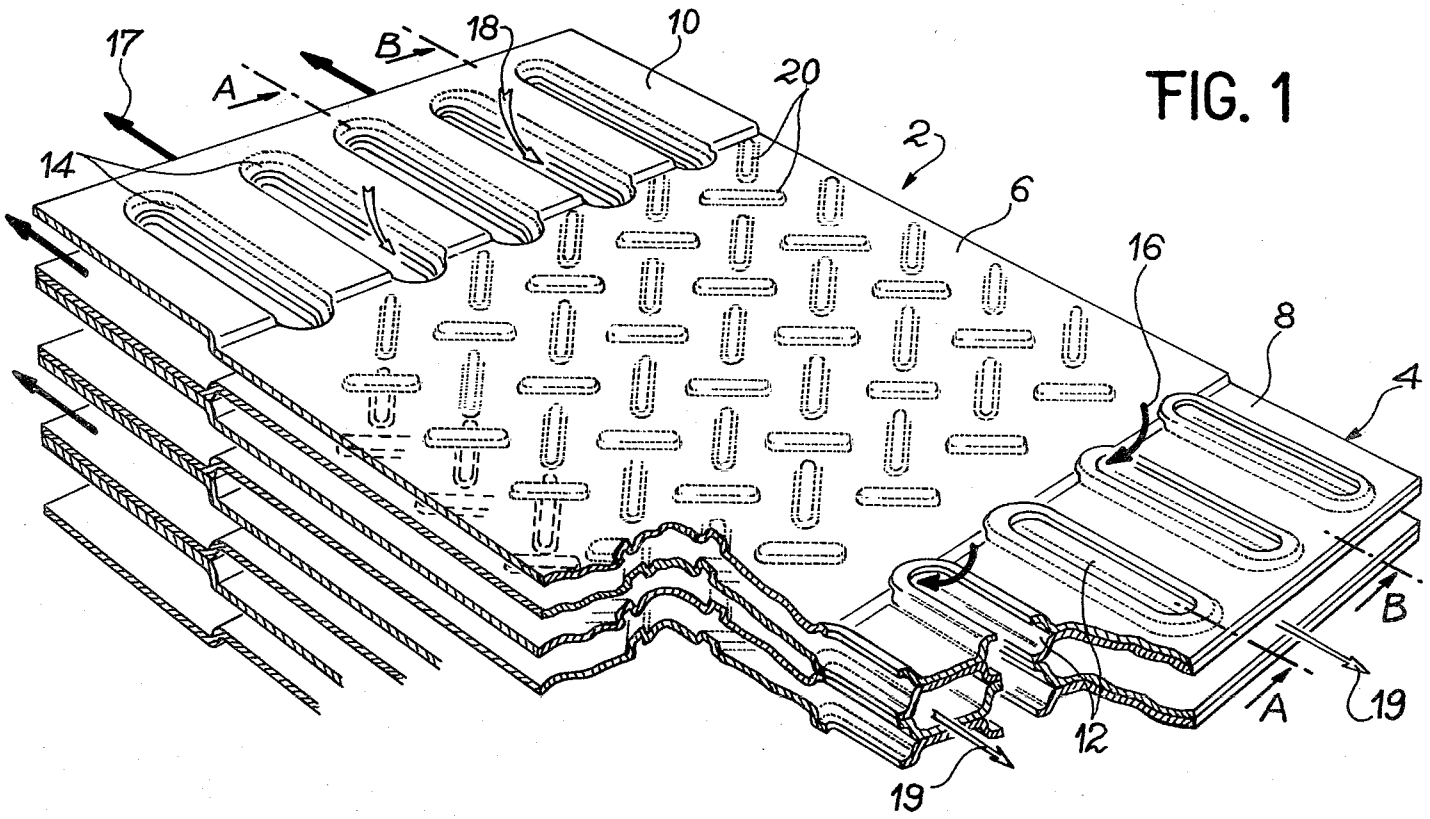

The present invention relates to a rigid structure plate heat exchanger.

Heat exchangers make it possible to pass a heat flow from a first liquid flow which cools to a second liquid flow which heats. Plate exchangers are constituted by a stack of appropriately spaced plates between which the two flows circulate in an alternating manner. To obtain the most effective heat exchange it is known to use a countercurrent flow arrangement, the flow rates being substantially parallel and opposed. However, this leads to a relatively complex construction of the collecting areas at the ends of the exchange path. Although thermally less efficient it is for this reason that the cross flow arrangement is often adopted.

In order to permit the economic manufacture of countercurrent plate exchangers it has previously been proposed to form a collector by a line of passages or shafts having, for example, a circular cross-section and positioned perpendicular to the juxtaposed plates along one edge of the stack and open in alternate spaces between the plates. These passages or shafts are obtained by perforations made in the plates and tight joints. Thus, one of the flows is collected by the passages, whilst the other flow leads to the corresponding face of the stack between the passages.

The four collectors for the admission and discharge of the two flows are constituted by two lines of passages and the two corresponding flow faces where the plates are in contact in pairs. It is possible for one flow to be collected by the two lines of passages and for the other flow to be collected by the faces. Alternatively each flow can be collected by a line of passages and one face, the latter arrangement being adopted for the purposes of the following description and the drawings. The two flows can be substantially equal in mass and volume and then a uniform spacing e is adopted between the plates. The following explanations correspond to this case, but can easily extend to different spacing $e_1$ and $e_2$ for the two flows.

In exchangers of this type the distribution passages preferably have a cross-section elongated in the direction of fluid circulation from one distribution area to the next, which makes it possible to obtain large passage cross-sections compared with the section corresponding to the thickness between the plates.

A plate heat exchanger of this type is described in French Pat. No. 1 038 859. It describes a heat exchanger for two media flowing in opposite directions. Parallel plates provide passages for the fluid media. The end parts of these plates are connected by perpendicular transverse pipes which, according to one embodiment, can have a pear-shaped cross-section.

However, an exchanger of this type does not have a rigid structure. Thus, one plate in the stack only rests by its periphery on the plate immediately below it. There is no intermediate bearing point between a plate 1 and the lower plate 2 in an exchange area. Collars 1*c*, 2*c* form borders of perforations of the passages. The collars 1*c* are relatively short, whilst collars 2*c* are relatively long. A plate 1 thus rests on plate 2, which is below it, by the circumference of collar 2*c*. It is therefore necessary to stiffen this exchanger by means of spacers such as braces 3*a*.

However, the present invention relates to a plate heat exchanger which in itself has a rigid structure. The plates of this exchanger have two planar surfaces, namely an upper planar surface and a lower planar surface. One of the planar surfaces is constituted by the plane of the distribution area, whilst the other planar surface on the same side of the exchanger is constituted by the plane of the border of the perforations of the passages. When these plates are stacked on one another a rigid structure is obtained without it being necessary to use any spacers.

Therefore the present invention relates to a plate heat exchanger comprising a stack of appropriately spaced parallel plates having a central exchange area and two parallel borders which, by their stacking, form two distributor blocks, whereby in a block distribution takes place for one space out of each pair by directly issuing on to the face of the stack and for the other space of each pair by issuing on to a line of passages obtained by perforations elongated in the direction of the flow of fluids from one distributor block to the other and which face one another throughout the stack, wherein the planes of the parallel borders of the plates are displaced on either side of the plane of the central exchange area in such a way that when the stack of plates is formed, one of the borders of one plate is in planar contact with the border of the plate immediately above it, whilst the other border of said plate is in contact with the border of the plate immediately below it leading to a concertina structure sealing alternate spaces in each distributor block and wherein the borders of the perforations of the passages are deformed in the direction opposite to the displacement of the border with respect to the central area so as to come into contact with the border of the perforation of the passage in the adjacent plate, the planar contact between the parallel distribution borders extending to the part of the regions located between the passages, but not to the region facing the central exchange area.

Contact between the two plates over a large part of the distribution area leads to greater robustness of the assembly, particularly when very thin sheets are used. The plane of one or both distribution areas is displaced with respect to that of the exchange area leading to pairwise contact between these distribution areas, provided that the normal spacing is maintained between the exchange area and the end facing each perforation and provided that portions are locally raised to form the walls of the passages.

According to the invention the plates are joined together in pairs by assembling their edges and/or contacting edges of passages. This leads to a concertina-like arrangement. The connections are made over the entire periphery of the passages. These connections can be obtained by swaging inserted or stamped rivets. They can also be obtained directly on the basis of the actual plates by glueing the precoated areas, welding plastic films deposited on the plates or welding the actual plates when they are made from an appropriate material. It is also possible to use inserts of a plastic material assembled in situ.

In this way lines of distribution passages are obtained, whose passage cross-section can be as large as required in order to supply the complete stack, whilst permitting a fine distribution of the fluid between the plates. The distribution passages only open out by their small side which is oriented towards the exchange area. Thus, the rigidity of the stack is ensured by the two large sides and by the small side of the opening, whose walls are parallel to the crushing stresses.

According to another feature of the invention elongated bosses are made in the exchange area. These bosses can be inclined relative to the plate axis and can in particular be oriented in alternating manner, e.g. at 45° on either side of the general flow direction of the gaseous filaments. The height of these bosses can be equal to the spacing of the plates. In this case each boss then bears on a smooth part of the exchange area. The height of the bosses can also be equal to half the spacing of the plates. Thus, when these plates are superimposed in the stack after rotating alternating plates by 180° about its transverse axis, said bosses come into contact with one another, e.g. at right angles. This ensures the continuity of the walls parallel to the axis of the crushing stresses. Moreover, these bosses increase the length of the path of the gaseous filaments in the exchange area.

The plate heat exchanger according to the invention has inherent rigidity characteristics making it possible to considerably reduce the thickness of the plates used and consequently their weight.

The invention is described in greater detail hereinafter relative to non-limitative embodiments and the attached drawings, wherein show:

FIG. 1—a perspective view of an exchanger according to the invention.

Figure 2:
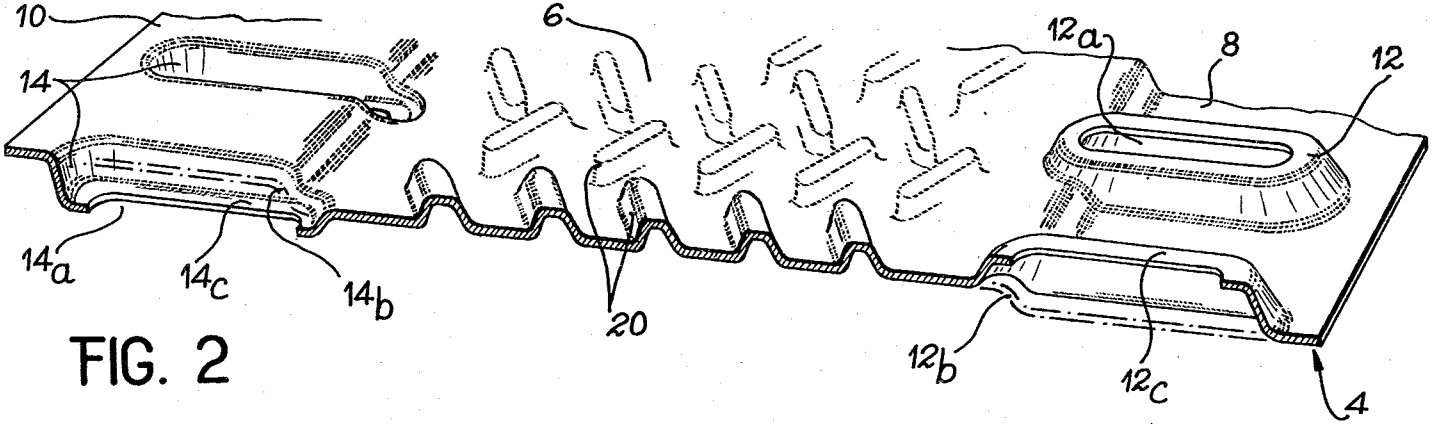

FIG. 2—a perspective view of a plate of the exchanger shown in FIG. 1.

Figure 3:
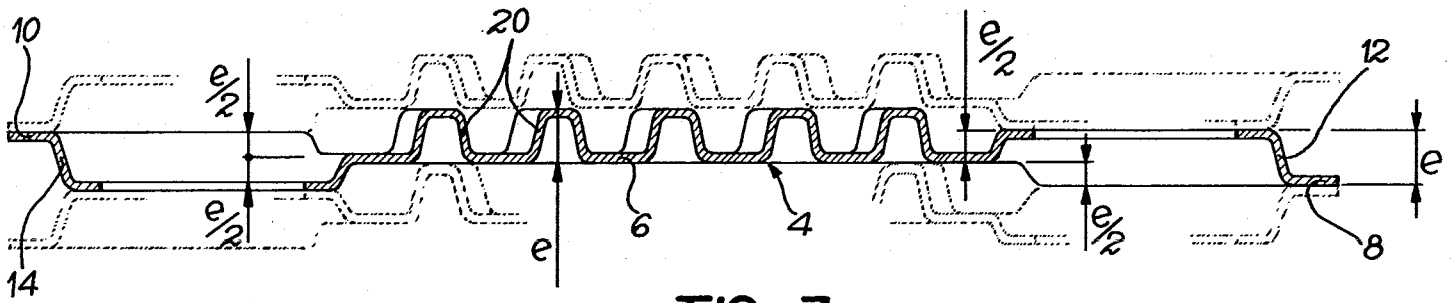

FIG. 3—a longitudinal section through the plate of FIG. 2.

Figure 4A:
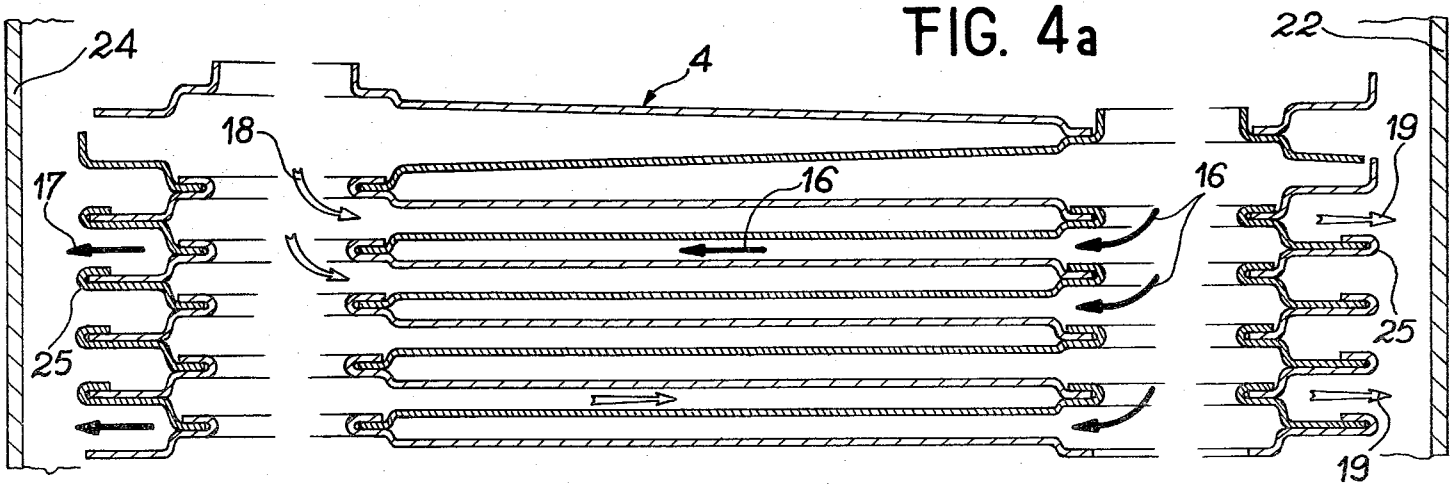
Figure 4B:
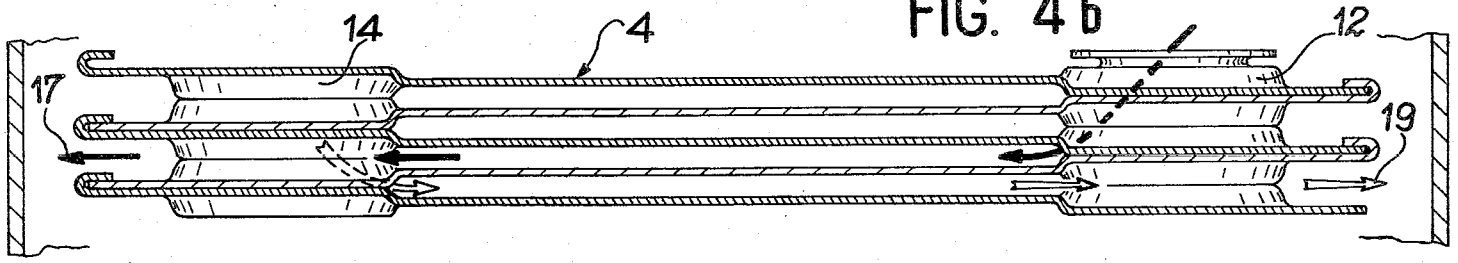

FIGS. 4*a* and 4*b*—a longitudinal section of the exchanger of FIG. 1.

Figure 5:
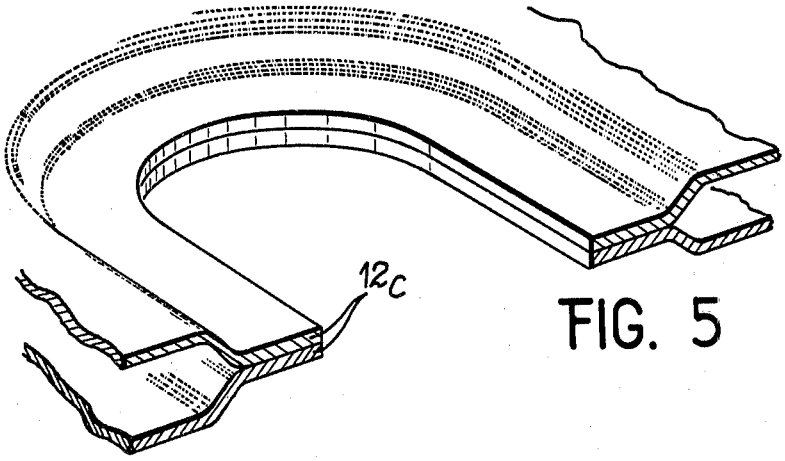
Figure 6:
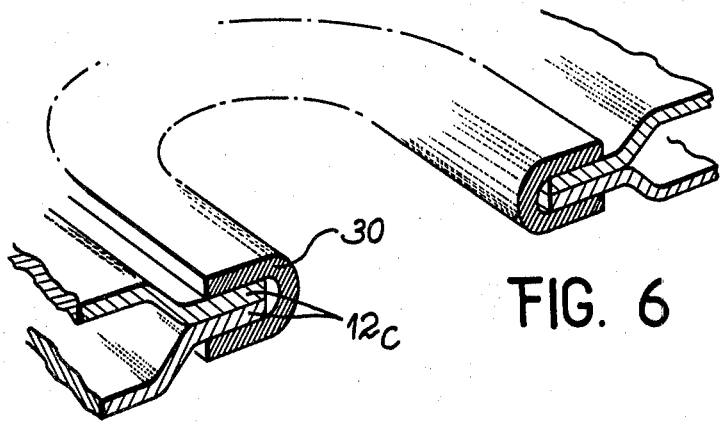
Figure 7:
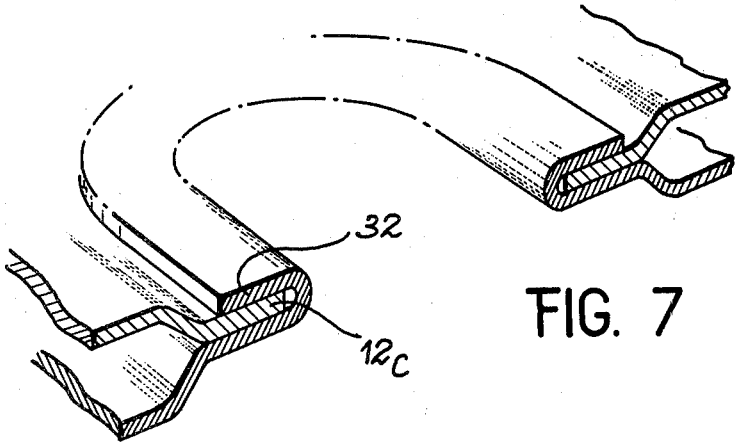

FIGS. 5 to 7—different constructional variants of the assembly of the edges of the distribution passage.

Figure 8:
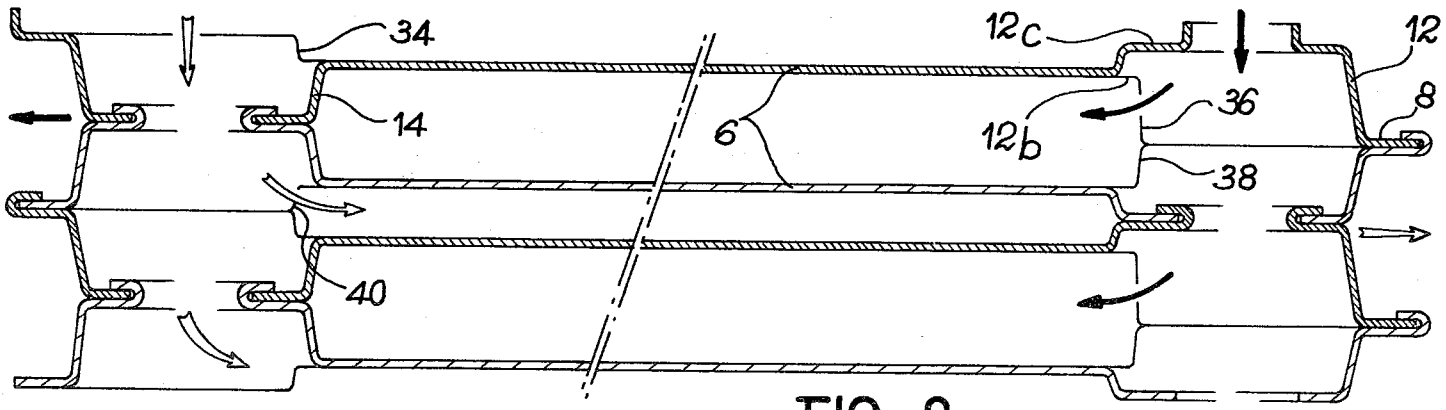
Figure 9:
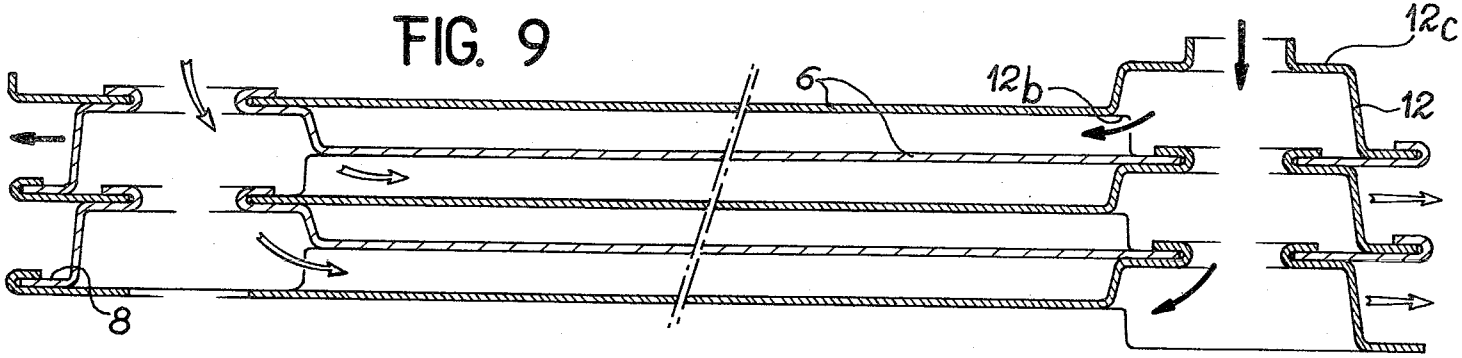

FIGS. 8 and 9—longitudinal sections of constructional variants of the invention.

Figure 10:
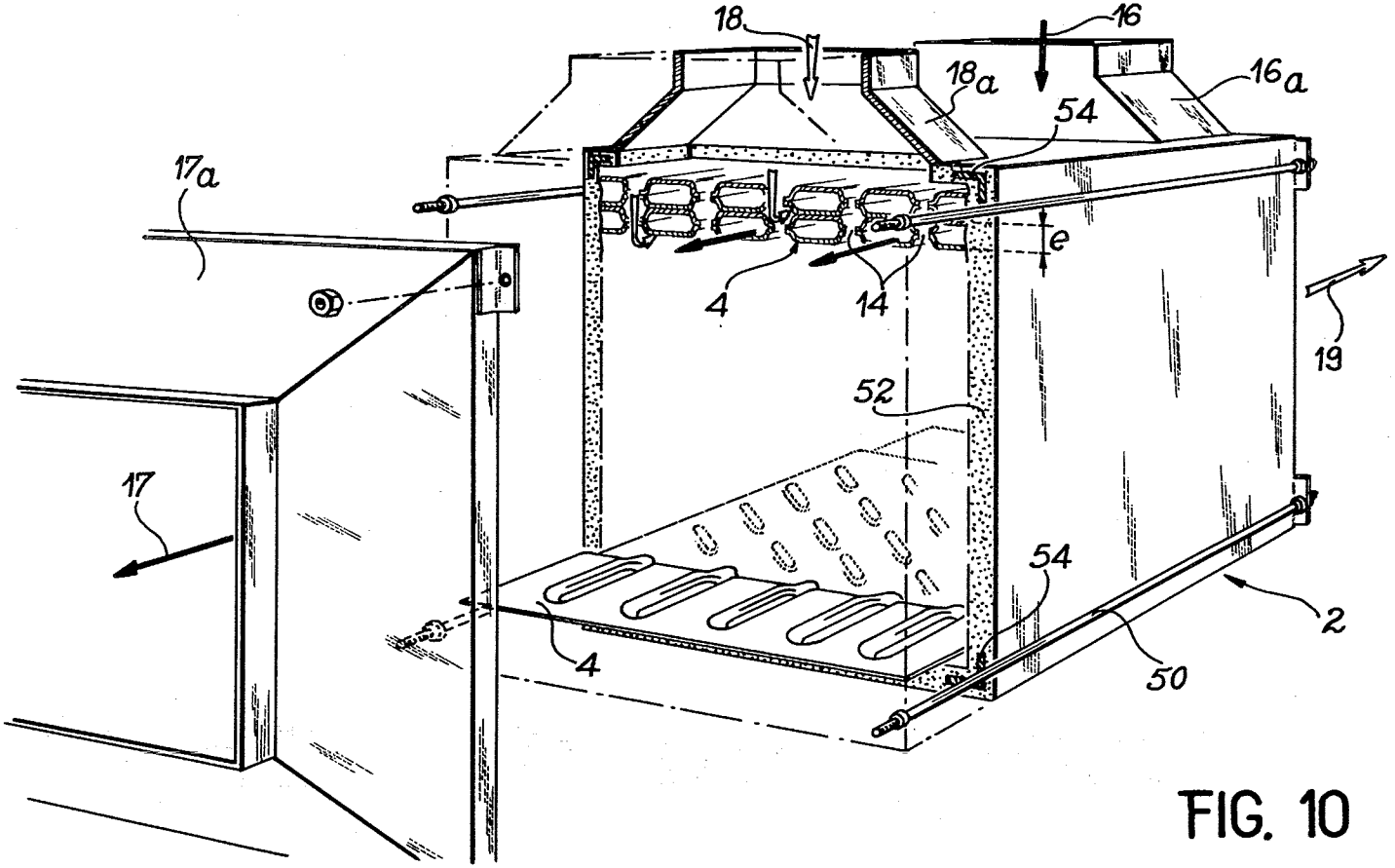

FIG. 10—a perspective view of an embodiment in which the lateral insulation of the plates is obtained by means of a foam with closed pores in which are embedded reinforcing sections.

Figure 11:
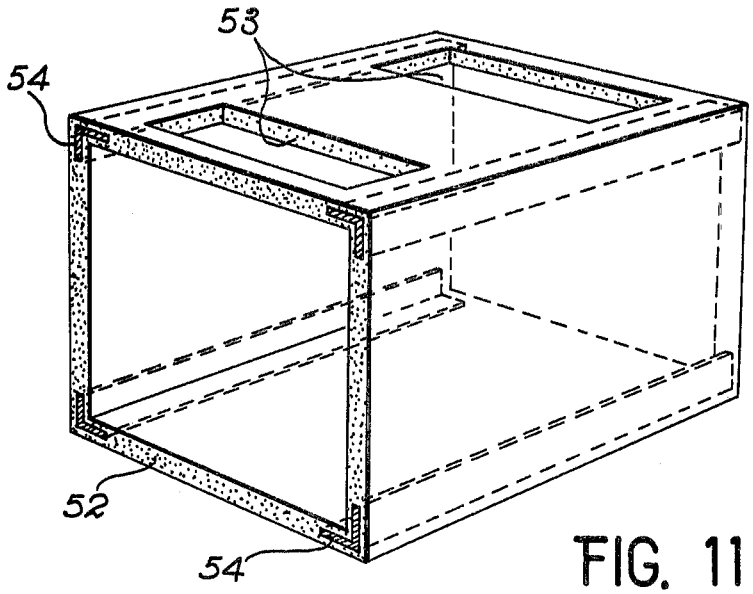

FIG. 11—a perspective view of the exchanger of FIG. 10 showing the shape of the single casing.

Figure 12:
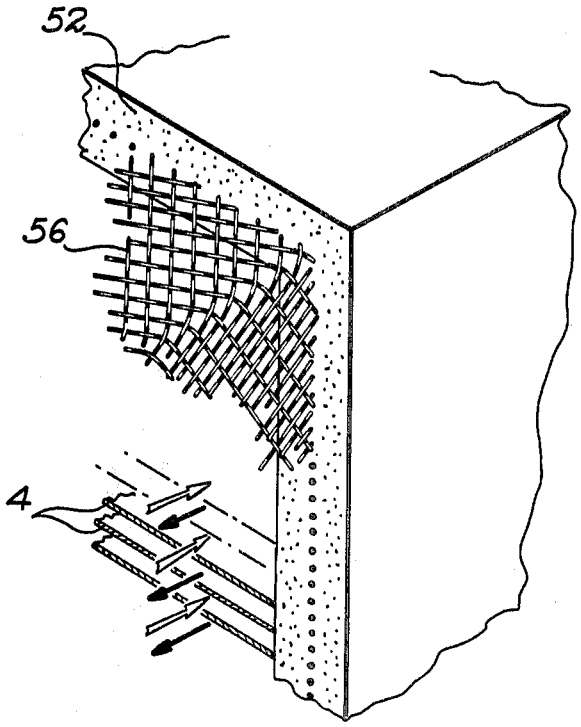

FIG. 12—a detail of the insulation of the plates of the exchanger of FIGS. 10 and 11 in which a metallic reinforcing texture has been embedded.

FIG. 1 is a perspective view of an exchanger 2 according to the invention. This exchanger is a static heat recuperator functioning between two gaseous filaments flowing in opposite directions. It can in particular be used for air conditioning and for recovering heat lost by the ventilation of rooms.

Exchanger 2 is constituted by a stack of rectangular stamped sheets 4. Sheets 4 are stacked with a spacing e and are pressed together to define two separate circuits in which the fluid filaments flow. Each sheet 4 has a central area 6, called the exchange area in which the actual heat exchange takes place, as well as two distribution areas 8 and 10, located on either side of exchange area 6 and in which are formed the distribution shafts or passages 12, 14. These passages are constituted by elongated stamped pieces located in the fluid flow direction. A first gaseous flow 16 enters the exchanger by distribution passages 12. Fluid 16 circulates along the exchange area 6 and leaves the exchanger at 17. A second fluid 18 enters exchanger 2 by distribution passages 14, circulates along the exchange surface 6 and then leaves the exchanger at 19.

According to the invention the planes of the distribution areas 8 and 10 are displaced on either side of the plane of the exchange area 6 by a quantity equal to half the spacing e of plates 4. As can be gathered from FIG. 1 the plane of distribution area 8 of plate 4 is positioned lower than the plane of exchange area 6, whilst the plane of distribution area 10 is raised with respect to the latter. The stack of exchanger plates is formed by alternately superimposing plates such as plate 4 and identical plates turned by 180° about their transverse axis. Thus, distribution area 8 comes into contact with the distribution area of the plate immediately below it. In the same way distribution area 10 comes into contact with the distribution area of the plate immediately above it.

Exchange area 6 has inclined elongated bosses on either side of the longitudinal axis of plate 4. In the present embodiment these bosses are inclined by 45° on either side of the general flow direction of the gaseous filaments. As will be described in greater detail hereinafter the height of these bosses is preferably equal to the spacing e of the plates. Thus, when these plates are superimposed and after rotating every other plate, the bosses 20 bear against one another and form right angles. Moreover, the bosses 20 make it possible to significantly increase the length of the path of the gaseous filaments in exchange area 6.

According to another embodiment bosses 20 can be formed on each of the faces of exchange area 6, their height being equal to half the spacing e. The bosses formed on the upper surface of one plate thus come into contact, after turning, with those of the upper plate. The continuity of the walls parallel to the axis of the crushing stresses is therefore also ensured.

FIG. 2 is a perspective view of a plate 4 of the exchanger shown in FIG. 1. It is possible to see exchange area 6, distribution areas 8, 10, distribution passages 12, 14 and bosses 20. It is in particular possible to see the shape of distribution passages 12, 14. Elongated openings, respectively 12*a*, 14*a* and through which the fluids circulate are formed at the top of the stamped piece. The passage cross-section of the exchange passages can be as large as desired, making it possible to supply the complete stack, whilst retaining a fine distribution of the gaseous flow. As can be seen in FIG. 2 one end of each distribution passage, respectively 12*b*, 14*b* is formed in exchange area 6. This arrangement defines an orifice through which the fluid can flow between the exchange areas of two successive plates. Thus, the distribution passages 12, 14 only issue or open out by their small side 12*b*, 14*b* oriented towards the exchange area 6. Thus, the rigidity of the stack is ensured along the large sides and the remaining small side. Thus, the plates bear against one another in pairs by edges 12*c* and 14*c* of distribution passages 12 and 14. Edge 12*c* comes into contact with the edge of the distribution passage of the plate immediately above it. Edge 14*c* of distribution passage 14 comes into contact with the edge of the plate immediately below it.

FIG. 3 is a longitudinal section of plate 4 of FIG. 2. The drawing shows the respective heights as a function of the spacing e of the plates of distribution passages 12, 14 and bosses 20. As can be seen the planes of distribution areas 8, 10 are displaced on either side of the plane of exchange area 10 by a quantity equal to half the spacing e of the plates. Furthermore the height of distribution passages 12, 14 with respect to the plane of exchange area 6 is equal to spacing e. Finally it is pointed out that the height of bosses 20 is equal to spacing e. In this way an exchanger with a greater rigidity is obtained. This arrangement makes it possible to considerably reduce the thickness of plates 4 and consequently their weight. In the case of the present embodiment a satisfactory rigidity at all points has been obtained with 0.2 mm thick aluminium sheets.

FIG. 4 shows a longitudinal section of the exchanger of FIG. 1. FIG. 4*a* shows a longitudinal section along line AA passing through the centre of the distribution passages. FIG. 4*b* shows a longitudinal section of the same exchanger along line BB, which does not intersect the distribution passages 12, 14. Bosses 20 are not shown for reasons of clarity.

FIG. 4*a* shows the two separate flow circuits for fluids 16 and 18. In the drawing fluid 16 circulates from right to left and leaves the exchanger at 17, whilst fluid 18 circulates from left to right and leaves the exchanger at 19.

FIG. 4*b* shows the connection of the distribution passages such as 12 and 14. These connections can be made over the entire circumference of the passages, can be obtained by swaging rivets which are inserted or stamped directly from the actual plates or by adhesion or glueing. The way in which the necessary sealing is obtained between the two gaseous filaments in the distribution areas with respect to the distribution passages will be described in greater detail relative to FIGS. 5 to 7.

Exchanger 2 according to the invention can be placed in a casing provided with appropriate fixing and connecting means in a single operation. The lateral sealing of plates 4 is obtained by means of a flexible foam sheet or any other appropriate known means. The longitudinal sealing of plates 4 can be obtained in the manner shown in FIGS. 4*a* and 4*b* by turning edges 25 or by any other appropriate means.

FIGS. 5 to 7 show different ways of bringing about the sealing between the edges of the distribution passages. As the suitability and quality of a heat exchanger is linked with the sealing between the two gaseous filaments circulating in countercurrent manner, the way in which this sealing is obtained is an important feature of the exchanger according to the invention.

As stated hereinbefore the exchanger plates are made from 0.2 mm thick aluminium sheeting. There are three possible processes for joining the edges 12*c* of the distribution passages. In FIG. 5 the edges are assembled by glueing or adhesion and the operation can be performed with a quick-setting adhesive. A polyethylene film can also be deposited on one of the faces of the plate. The coated faces of the two successive plates are then joined together and then placed under a hot press so as to melt the polyethylene film. After cooling the latter forms a weld. However, the latter process is expensive.

FIGS. 6 and 7 show two assembly procedures using rivets. FIG. 6 shows an inserted oblong rivet 30 made from aluminium or a plastic material, whilst FIG. 7 shows a rivet 32 formed in one of the plates at the time of manufacture and consequently integral with the latter. These two processes have given the best results, both as regards production costs and performance speed.

In the case of a plate exchanger according to the invention made from a plastics material the edges are either hot-adhered under a press in the case where a polyethylene film is used or coating is used in the case of PVC. It would also be possible to use inserted aluminium rivets 30, as described with reference to FIG. 6.

FIGS. 1 to 4 relate to a heat exchanger, whereof the planes of the distribution areas are displaced on either side of the plane of the exchange area by a quantity equal to half the spacing of the plates. Obviously this is not obligatory and FIGS. 8 and 9 show in an identical manner to FIG. 4*a* a longitudinal section of a heat exchanger, whereof the planes of the distribution areas are displaced by a random quantity on either side of the plane of the exchange area.

In FIG. 8 each plate has in its distribution areas stamped reliefs of different heights 34, 36, 38, 40, constituting the passages and the sides of the passages cooperate with one another.

In FIG. 9 only one distribution area is provided with a stamped relief 12. In this case the edge of the passage cooperates with the edge of the opening made in the distribution area.

Thus, the invention makes it possible to form countercurrent exchangers with integrated collectors obtained by stacking stamped plates in which the collectors can have a large cross-section compared with the passage section of an elementary flow between two plates. This makes it possible to stack a large number of plates and obtain very compact monobloc exchangers for the given applications. They are more particularly used in the air conditioning of rooms, with limited pressure differences between one flow and the other. As a result the plates can be formed from a thin metallic sheet, this being the material mainly envisaged for the assemblies described hereinbefore.

The exchanger 2 shown in perspective view in FIG. 10 is constituted by a stack of stamped rectangular sheets 4. Sheets 4 are stacked with a spacing e and are pressed together to define two separate circuits in which the fluid filaments flow. A first gaseous flow 16 penetrates the upper part of the exchanger. Gaseous flow 16 circulates along the exchange area of the exchanger and then leaves it at 17. A second flow 18 enters the upper part of the exchanger by distribution passages 14, circulates along the exchange surface and then leaves it in accordance with arrow 19. In the upper part of exchanger 2 are fitted two distributors 16*a*, 18*a*, which distribute fluids 16, 18 within the respective distribution passages. Collectors, whereof only collector 17*a* is shown, pipe the fluids 17, 19 leaving the exchanger. The two collectors are held in place by tie rods 50.

According to the invention the lateral sealing of plates 4 is obtained by a foam 52 having closed pores. Longitudinal sections such as 54 are embedded in said foam 52. These sections are more particularly shown in FIG. 11. Foam 52 can be an epoxy resin, a prepolymer foam or a phenolic foam.

FIG. 11 shows two rectangular openings 53 to the right of the distribution passages in order to permit the passage of fluid flows 16, 18. In addition to the advantages referred to hereinbefore insulation 52 provides a thermal insulation and complete sealing between flows 16 and 18 as a result of the two components of this foam which produces closed cavities or pores. This constitutes an important feature, because the suitability of a heat exchanger is linked with the sealing between the two gaseous flows circulating in countercurrent manner. Due to the reinforcement by shaped sections 54 it is possible to eliminate the prior art metal casing. This reduces the cost of the exchanger in which the casing represented an important cost factor. In addition, insulation 52 also forms the packing for the purpose of dispatching the exchanger.

FIG. 12 shows a constructional variant in which a texture 56 is embedded in foam 52. Texture 56 can be metallic or plastic and improves the rigidity of the assembly. Insulation 52 can be produced either by injection or by moulding.

According to an exemplified embodiment an injectable thermosetting foam is used having two components which become semi-hard in a very short time. The characteristics of this foam are indicated hereinafter. The foam is deposited by means of a gun which automatically mixes the two components. In order to insulate one face it is merely necessary to vertically position at 3 cm from the exchanger wall a rigid panel occupying the surface of said wall. The panel is provided with diameter 8 mm cylindrical openings used both for the injection of the foam and for the discharge of air when the foam is injected. After approximately 60 seconds this thermosetting foam is dry. It is then merely necessary to remove the panel. In this way the exchanger side wall is insulated.

TECHNICAL CHARACTERISTICS OF FOAM TYPES

| | 30 kg/m$^3$ |
|---|---|
| Reaction time by normal temperature | 60 sec. |
| Coefficient λKcal mh °C. after 6 months at 60° C. | 0.020 |
| Closed cells % | 90 |
| Temperature for use °C. | −210 to +100 |
| Compressive strength parallel to development kg/cm$^2$ | 1.12 |
| Compressive strength perpendicular to development kg/cm$^2$ | 1.05 |
| Tensile strength parallel to development kg/cm$^2$ | 1.4 |
| Tensile strength perpendicular to development kg/cm$^2$ | 1.68 |
| Bending strength parallel to development kg/cm$^2$ | 2.8 |
| Dimensional stability after 2 days at - 10° C. | |
| Volume change % | −2 |
| Dimensional stability after 7 days at 70° C. and 100% HR | |
| Volume change % | +18 |
| Permeability to steam transmission Perm/inches 1 Perm = 0.659 g/m$^2$ 24 h mm Hg | 2 |

We claim:

1. A plate heat exchanger comprising a stack of appropriately spaced parallel plates having a central exchange area and two parallel borders which, by their stacking, form two distributor blocks, whereby in a block distribution takes place for one space out of each pair by directly issuing on to the face of the stack and for the other space of each pair by issuing on to a line of passages obtained by perforations elongated in the direction of the flow of fluids from one distributor block to the other and which face one another throughout the stack, wherein the planes of the parallel borders of the plates are displaced on either side of the plane of the central exchange area in such a way that when the stack of plates is formed, one of the borders of one plate is in planar contact with the border of the plate immediately above it, whilst the other border of said plate is in planar contact with the border of the plate immediately below it leading to a concertina structure sealing alternate spaces in each distributor block and wherein the borders of the perforations of the passages are deformed in the direction opposite to the displacement of the border with respect to the central area so as to come into contact with the border of the perforation of the passage in the adjacent plate, the planar contact between the parallel distribution borders extending to the part of the regions located between the passages, but not to the region facing the central exchange area.

2. A heat exchanger according to claim 1, wherein the central areas have bosses, whose height is equal to the spacing between the plates and cooperating with one or other of the adjacent plates in a smooth part.

3. A heat exchanger according to claim 2, wherein the bosses are elongated and inclined relative to the general flow direction.

4. A heat exchanger according to claim 1, wherein the central areas have bosses, whose height is less than the spacing between the plates and cooperating with other bosses located on adjacent plates.

5. A heat exchanger according to claim 4, wherein the bosses are elongated and inclined relative to the general flow direction.

6. A heat exchanger according to any one of the claims 1, 2, 3, 4 or 5, wherein the spacing between adjacent planar plates in the exchange area is constant throughout the stack.

7. A plate exchanger according to claim 6, wherein it has a lateral insulation of the plates formed by means of a closed pore foam in which reinforcing sections are embedded.

8. An exchanger according to claim 7, wherein the closed pore foam is chosen from the group including epoxy resins, prepolymer foams and phenolic foams.

9. An exchanger according to claim 7, wherein it also has a plastic or metallic texture embedded in the foam.

10. An exchanger according to claim 9, wherein the closed pore foam is chosen from the group including epoxy resins, prepolymer foams and phenolic foams.

11. A plate exchanger according to any one of the claims 1, 2, 3, 4 or 5, wherein it has a lateral insulation of the plates formed by means of a closed pore foam in which reinforcing sections are embedded.

12. An exchanger according to claim 11, wherein the closed pore foam is chosen from the group including epoxy resins, prepolymer foams and phenolic foams.

13. An exchanger according to claim 11, wherein it also has a plastic or metallic texture embedded in the foam.

14. An exchanger according to claim 13, wherein the closed pore foam in chosen from the group including epoxy resins, prepolymer foams and phenolic foams.

* * * * *